US010037731B2

(12) United States Patent
Kawano

(10) Patent No.: US 10,037,731 B2
(45) Date of Patent: Jul. 31, 2018

(54) DRIVER, ELECTRO-OPTICAL APPARATUS, AND ELECTRONIC DEVICE

(71) Applicant: SEIKO EPSON CORPORATION, Tokyo (JP)

(72) Inventor: Shigeaki Kawano, Fujimi-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 215 days.

(21) Appl. No.: 15/056,139

(22) Filed: Feb. 29, 2016

(65) Prior Publication Data

US 2016/0260385 A1 Sep. 8, 2016

(30) Foreign Application Priority Data

Mar. 4, 2015 (JP) ..... 2015-042037

(51) Int. Cl.
*G09G 3/36* (2006.01)
*G09G 3/3258* (2016.01)
*G09G 3/20* (2006.01)

(52) U.S. Cl.
CPC ..... *G09G 3/3258* (2013.01); *G09G 3/20* (2013.01); *G09G 3/3648* (2013.01); *G09G 2330/028* (2013.01)

(58) Field of Classification Search
CPC ... G09G 2310/0291; G09G 2310/0294; G09G 2330/00–2330/12
See application file for complete search history.

(56) References Cited

U.S. PATENT DOCUMENTS

| | | | | |
|---|---|---|---|---|
| 5,986,649 | A | 11/1999 | Yamazaki | |
| 8,174,475 | B2 | 5/2012 | Nishimura et al. | |
| 2009/0160849 | A1* | 6/2009 | Kiya | G09G 3/2007 345/214 |
| 2009/0251064 | A1* | 10/2009 | Yaita | G09G 3/3291 315/291 |
| 2015/0379909 | A1* | 12/2015 | Yu | G09G 3/006 345/690 |

FOREIGN PATENT DOCUMENTS

| | | | |
|---|---|---|---|
| JP | 2002-062858 | A | 2/2002 |
| JP | 2007-212897 | A | 8/2007 |
| JP | 2009-118457 | A | 5/2009 |
| JP | 2010-145738 | A | 7/2010 |
| JP | 2012-070599 | A | 4/2012 |

* cited by examiner

*Primary Examiner* — Sanghyuk Park
(74) *Attorney, Agent, or Firm* — Oliff PLC

(57) ABSTRACT

A driver includes a power supply circuit including a voltage boosting circuit that generates a boosted voltage by performing a voltage boosting operation, and a driving circuit that receives a power supply from the power supply circuit, and samples a driving voltage to drive a display panel. The voltage boosting circuit has a voltage boosting unit having a voltage boosting transistor, and a voltage boosting control circuit that outputs a voltage boosting clock signal to the voltage boosting unit. The voltage boosting control circuit stops the voltage boosting clock signal in a first period that includes a timing of an end of a sampling period of the driving circuit.

13 Claims, 15 Drawing Sheets

SAMPLING PERIOD

HOLDING PERIOD

DRIVER, ELECTRO-OPTICAL APPARATUS, AND ELECTRONIC DEVICE

BACKGROUND

1. Technical Field

The present invention relates to drivers, electro-optical apparatuses, electronic devices, or the like.

2. Related Art

A driver that drives a display panel needs various types of voltages such as a power supply of a source drive amplifier, a power supply of a gate drive amplifier, a power supply of a gradation voltage generation circuit, and a common voltage of the display panel, and therefore includes a power supply circuit for generating these necessary voltages. For example, JP-A-2007-212897 and JP-A-2010-145738 disclose a power supply circuit having a plurality of voltage boosting circuits (primary voltage boosting circuit to quaternary voltage boosting circuit), and a driver that includes a source driver and a gate driver which operate while receiving power supplies generated by a voltage boosting operation of the voltage boosting circuits in the power supply circuit.

Some kinds of driver use a source driver of a type that samples and holds a driving voltage. For example, JP-A-2009-118457 discloses a source driver that has a D/A conversion circuit and a plurality of amplifier circuits, which sequentially sample and hold a gradation voltage that is output in a time division manner from the D/A conversion circuit, and drive source lines of the display panel based on the held gradation voltage.

The voltage boosting circuits included in the power supply circuit in the driver monitor a boosted voltage and repeat stop and resumption of the voltage boosting operation in order to maintain this boosted voltage at a substantially constant level. When resuming the voltage boosting operation, the resumption of the voltage boosting operation causes a ground voltage, a substrate voltage, or the like to fluctuate, for example, and the noise caused thereby is propagated to circuits or the like in the driver.

In the case of using a sample-hold source driver such as the one disclosed in JP-A-2009-118457, there is a possibility that the voltage (sampling voltage) held by the source driver has an error due to the aforementioned noise from the voltage boosting circuits. Since the driving voltage for driving pixels is determined by the voltage held by the source driver, a write voltage of the pixels becomes inaccurate.

SUMMARY

According to some aspects of the invention, it is possible to provide a driver that includes a voltage boosting circuit and in which a source driver can accurately sample a driving voltage, an electro-optical apparatus, an electronic device, or the like.

An aspect of this invention concerns a driver including: a power supply circuit including a voltage boosting circuit that generates a boosted voltage by performing a voltage boosting operation; and a driving circuit that receives a power supply from the power supply circuit, and samples and holds a driving voltage to drive a display panel, wherein the voltage boosting circuit has: a voltage boosting unit having a voltage boosting transistor; and a voltage boosting control circuit that outputs a voltage boosting clock for controlling the voltage boosting transistor to the voltage boosting unit, and the voltage boosting control circuit stops the voltage boosting clock in a first period that includes a switching timing of switching from a sampling period to a holding period of the driving circuit.

According to an aspect of the invention, the voltage boosting clock for controlling the voltage boosting transistor is stopped in the first period that includes the switching timing of the switching from the sampling period to the holding period of the driving circuit. The voltage boosting operation can thereby be stopped at the switching timing at which a hold voltage of the driving circuit is determined, and accordingly, the source driver can accurately sample the driving voltage.

According to an aspect of this invention, the voltage boosting control circuit may monitor the boosted voltage, and stop the voltage boosting clock in a second period after the boosted voltage exceeds a set voltage.

According to an aspect of this invention, the voltage boosting control circuit may have: a monitoring circuit that monitors the boosted voltage; and a voltage boosting clock generation circuit that generates the voltage boosting clock, and a voltage boosting enable signal that is input to the voltage boosting clock generation circuit may be inactive in the first period and the second period.

The boosted voltage can be maintained at (in the vicinity of) a fixed voltage by stopping the voltage boosting clock signal in the second period after the boosted voltage exceeds the set voltage. The voltage boosting clock signal is resumed after the second period ends, and noise is generated at this time. If this noise is generated in the vicinity of the switching timing of the switching from the sampling period to the holding period of the driving circuit, there is a possibility that the hold voltage of the driving circuit becomes inaccurate. In this regard, according to an aspect of the invention, the voltage boosting clock signal can be stopped in the first period. Accordingly, the voltage boosting operation is not resumed in the vicinity of the switching timing, and the driving circuit can accurately hold the driving voltage.

According to an aspect of this invention, the voltage boosting control circuit may have an enable signal generation circuit to which a control signal that is inactive in the first period is input, the enable signal generation circuit generating the voltage boosting enable signal that is inactive in the first period and the second period based on the control signal and a monitoring result from the monitoring circuit.

Stop and resumption of the voltage boosting clock signal by the monitoring circuit are feedback control within the voltage boosting circuit. For this reason, the voltage boosting clock signal is stopped and resumed by the monitoring circuit asynchronously with the switching timing of the switching from the sampling period to the holding period of the driving circuit. For this reason, there is a possibility that a timing of resuming the voltage boosting clock signal occurs in the vicinity of the switching timing. In this regard, according to an aspect of the invention, the voltage boosting enable signal can be inactivated in the first period as a result of the control signal, which is inactive in the first period, being input, and accordingly, the voltage boosting clock signal can be stopped in the first period.

According to an aspect of this invention, the voltage boosting circuit may generate the boosted voltage by performing the voltage boosting operation using charge pumping.

According to an aspect of the invention, in a case of deeming the voltage boosting circuit to be a first voltage boosting circuit, the power supply circuit may further have second to nth voltage boosting circuits (n is an integer of 2 or larger), a current supply capability of the first voltage boosting circuit may be higher than current supply capabilities of the second to nth voltage boosting circuits, and the voltage boosting control circuit may stop the voltage boosting clock of the first voltage boosting circuit in the first period.

In the case where the current supply capability of the voltage boosting circuit is high, the noise caused by an operation thereof tends to be large. For this reason, by stopping the voltage boosting clock signal of the voltage boosting circuit having the largest current supply capability in the first period, an error of the driving voltage held by the driving circuit can be effectively reduced.

According to an aspect of this invention, the driving circuit may have a source driver that operates with a power supply voltage that is based on a boosted voltage from the first voltage boosting circuit.

According to an aspect of this invention, the voltage boosting control circuit may stop the voltage boosting clock in the first period that includes a switching timing of switching from a sampling period to a holding period of the source driver.

The source driver is a circuit whose current consumption is large among drivers. For this reason, in the case where the power supply voltage of the source driver is generated based on the boosted voltage generated by the first voltage boosting circuit, the first voltage boosting circuit will have a high current supply capability. By stopping the voltage boosting clock signal of the first voltage boosting circuit having such a high current supply capability in the first period, an error of the driving voltage held by the driving circuit can be effectively reduced.

According to an aspect of this invention, the driving circuit may have a source driver that includes an amplifier circuit constituted by a flip-around sample-hold circuit.

According to an aspect of this invention, the amplifier circuit may have: an operational amplifier; and a sampling capacitor provided between an input node of the amplifier circuit and a first input node of the operational amplifier, and the amplifier circuit may store charge that corresponds to a voltage of the input node of the amplifier circuit in the sampling capacitor in the sampling period, and output a voltage that corresponds to the charge stored in the sampling capacitor in the holding period.

According to an aspect of the invention, even in the case of employing this kind of sample-hold amplifier circuit, an error of the hold voltage of the driving circuit generated by the noise at the time of resuming the voltage boosting operation can be reduced.

Another aspect of the invention concerns a driver including: a power supply circuit including a voltage boosting circuit that generates a boosted voltage by performing a voltage boosting operation; and a driving circuit that receives a power supply from the power supply circuit, and samples a driving voltage to drive a display panel, wherein the voltage boosting circuit has: a voltage boosting unit having a voltage boosting transistor; and a voltage boosting control circuit that outputs a voltage boosting clock for controlling the voltage boosting transistor to the voltage boosting unit, and the voltage boosting control circuit stops the voltage boosting clock in a first period that includes a timing of an end of a sampling period of the driving circuit.

Another aspect of the invention concerns an electro-optical apparatus that includes any of the above-described drivers.

Another aspect of the invention concerns an electronic device that includes any of the above-described drivers.

BRIEF DESCRIPTION OF THE DRAWINGS

The invention will be described with reference to the accompanying drawings, wherein like numbers reference like elements.

FIGS. 11A and 113 show detailed exemplary configurations of an amplifier circuit.

DESCRIPTION OF EXEMPLARY EMBODIMENTS

Hereinafter, a preferable embodiment of the invention will be described in detail. Note that the embodiment described below is not intended to unduly limit the content of the invention described in the scope of claims, and not all configurations described in this embodiment are necessarily essential as solving means of the invention.

For example, although the case where a voltage boosting circuit is a charge pump circuit will be described below as an example, the invention is also applicable to the case where the voltage boosting circuit is other than a charge pump circuit. That is to say, the invention is applicable to any voltage boosting circuit that boosts a voltage by means of charge transfer based on a voltage boosting clock (a voltage boosting clock that is stopped and resumed by feedback). For example, a voltage boosting circuit may be constituted by a diode, a capacitor, and a buffer circuit.

Although the case where a driving circuit samples and holds a driving voltage will be described below as an example, the driving circuit may not perform a holding operation. In this case, a voltage boosting control circuit stops a voltage boosting clock in a first period that includes a timing of an end of a sampling period of the driving circuit. For example, the following configuration can be conceived as an example where the holding operation is not performed.

That is to say, a switching element is provided as a sampling circuit between a source amplifier and a source line, and the source amplifier drives the source line in a period in which the switching element is in an on state that is deemed to be a sampling period. In this case, the voltage boosting clock is stopped in the first period that includes a timing of turning off the switching element (i.e., an end of the sampling period).

1. First Exemplary Configuration

Figure 1:
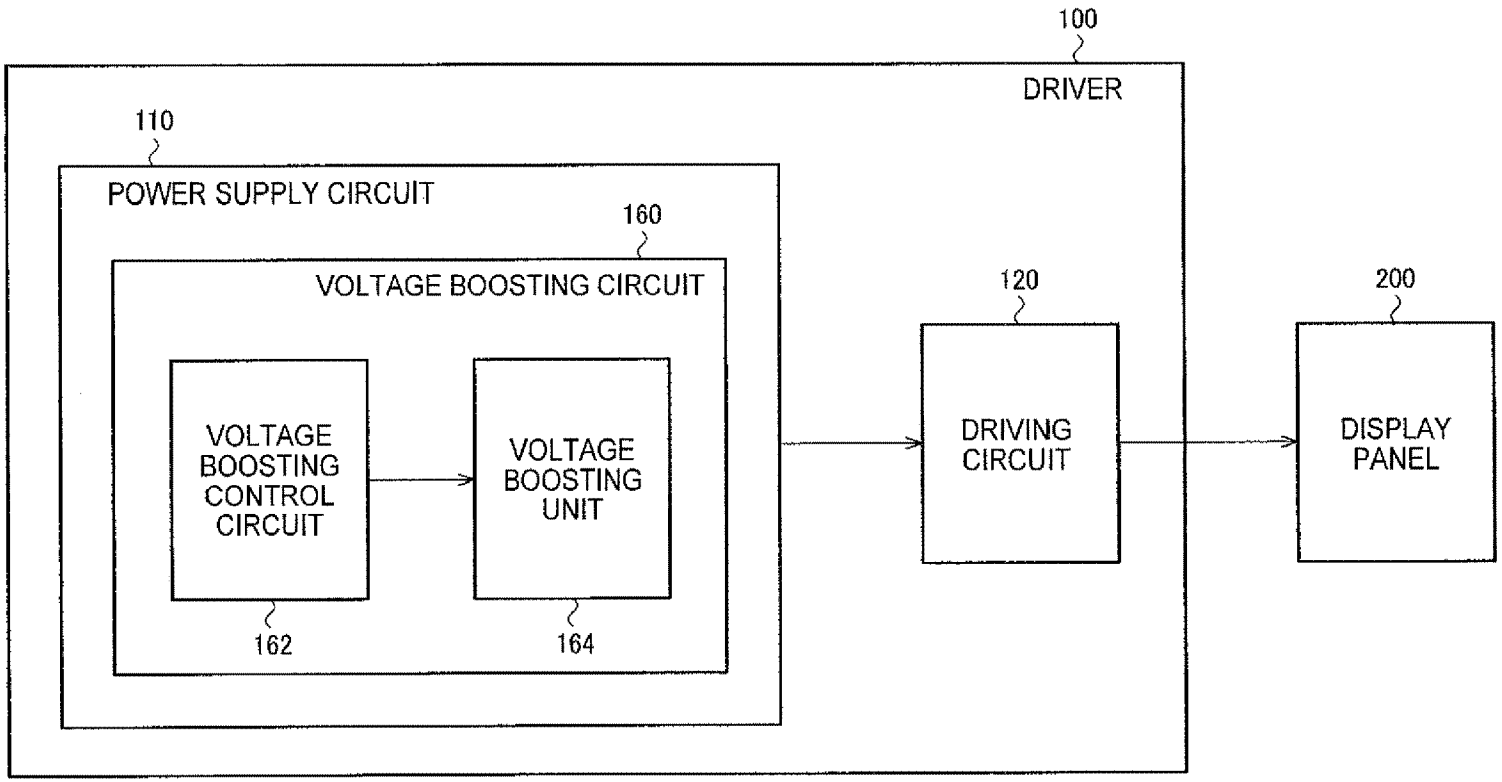
FIG. 1 shows a first exemplary configuration of a driver.

FIG. 1 shows a first exemplary configuration of a driver in this embodiment. This driver 100 includes a power supply circuit 110 that includes a voltage boosting circuit 160 for generating a boosted voltage by performing a voltage boosting operation using charge pumping, and a driving circuit 120 that receives a power supply from the power supply circuit 110, and samples and holds a driving voltage to drive a display panel 200.

Figure 2:
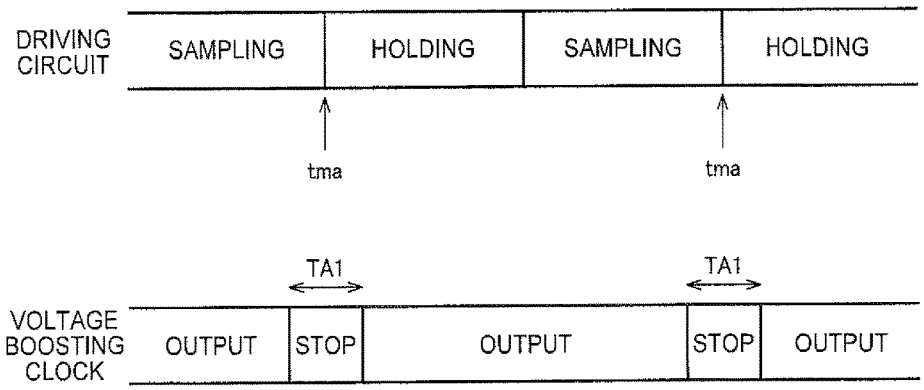
FIG. 2 is an illustrative diagram of operations in the first exemplary configuration of the driver.

The voltage boosting circuit 160 has a voltage boosting unit 164 having voltage boosting transistors, and a voltage boosting control circuit 162 that outputs a voltage boosting clock signal for controlling the voltage boosting transistors to the voltage boosting unit 164. As shown in FIG. 2, the voltage boosting control circuit 162 stops the voltage boosting clock signal in a first period TA1 that includes a switching timing tma of switching from a sampling period to a holding period of the driving circuit 120.

Specifically, the power supply circuit 110 generates a plurality of power supplies based on a boosted voltage generated by the voltage boosting circuit 160. For example, the power supply circuit 110 may further include a plurality of regulators that regulate the boosted voltage generated by the voltage boosting circuit to generate a power supply for each part of the driver 100.

The voltage boosting operation using charge pumping performed by the voltage boosting circuit 160 is an operation of boosting an input voltage by the voltage boosting transistors (e.g., TR1 to TR6 in FIG. 12) and a flying capacitor (CA in FIG. 12) performing a switched capacitor operation. The voltage boosting circuit 160 boosts a system voltage supplied from the outside of the driver 100, a boosted voltage generated by another voltage boosting circuit that is further included in the power supply circuit 110, or the output of the regulators to generate a boosted voltage. Here, "voltage boosting" includes not only the case of generating, from a positive (or negative) input voltage, a boosted voltage with the same, plus (or minus) sign, but also the case of generating, from a positive (or negative) input voltage, a boosted voltage with the opposite, minus (or plus) sign.

The driving circuit 120 is an amplifier circuit in which a sampling capacitor (e.g., CA in FIG. 11A) samples the driving voltage in the sampling period and holds the sampled voltage in the holding period.

Figure 11A:
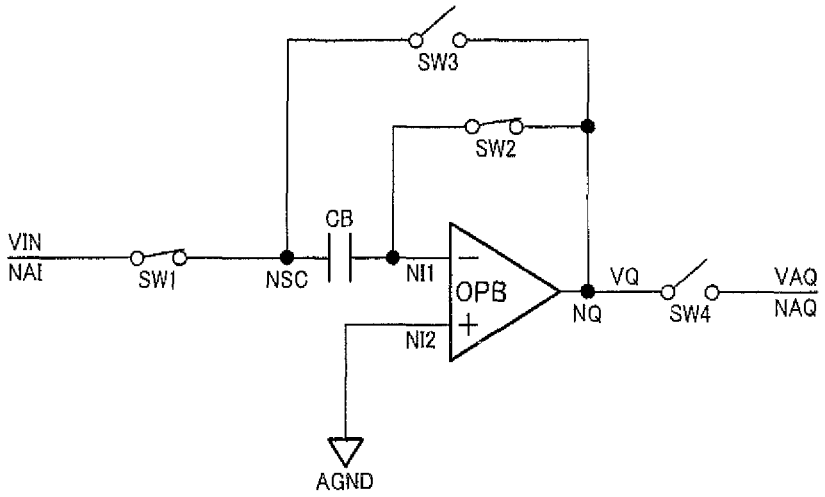

The voltage held in the holding period by the driving circuit 120 is determined at the timing tma of the switching from the sampling period to the holding period (e.g., determined when SW1 in FIG. 11A turns off). At this time, if noise caused by the switched capacitor operation of the voltage boosting circuit 160 is propagated to the driving circuit 120 via a substrate, a power supply line, or the like, the charge at the sampling capacitor is fluctuated by this noise, and a hold voltage is determined while having an error. Since a source voltage (data voltage) for driving pixels of the display panel 200 is determined based on the hold voltage, there is a problem of a decrease in display quality due to this error.

In this regard, according to this embodiment, the voltage boosting clock signal can be stopped in the first period TA1 that includes the switching timing tma of the switching from the sampling period to the holding period of the driving circuit 120. The voltage boosting operation is thereby stopped at the timing tma of the definition of the hold voltage, and therefore, the error of the hold voltage can be suppressed.

As described later, in the case of monitoring the boosted voltage to maintain the boosted voltage at a predetermined voltage, stop and resumption of the voltage boosting operation are repeated. With this method, noise at the time of the resumption is larger than in the case of steadily performing charge pumping, and therefore, if the timing of the resumption is close to the switching timing tma, the error of the hold voltage becomes large. In this embodiment, the influence of such noise at the time of resuming the voltage boosting operation can be avoided.

2. Second Exemplary Configuration

Figure 3:
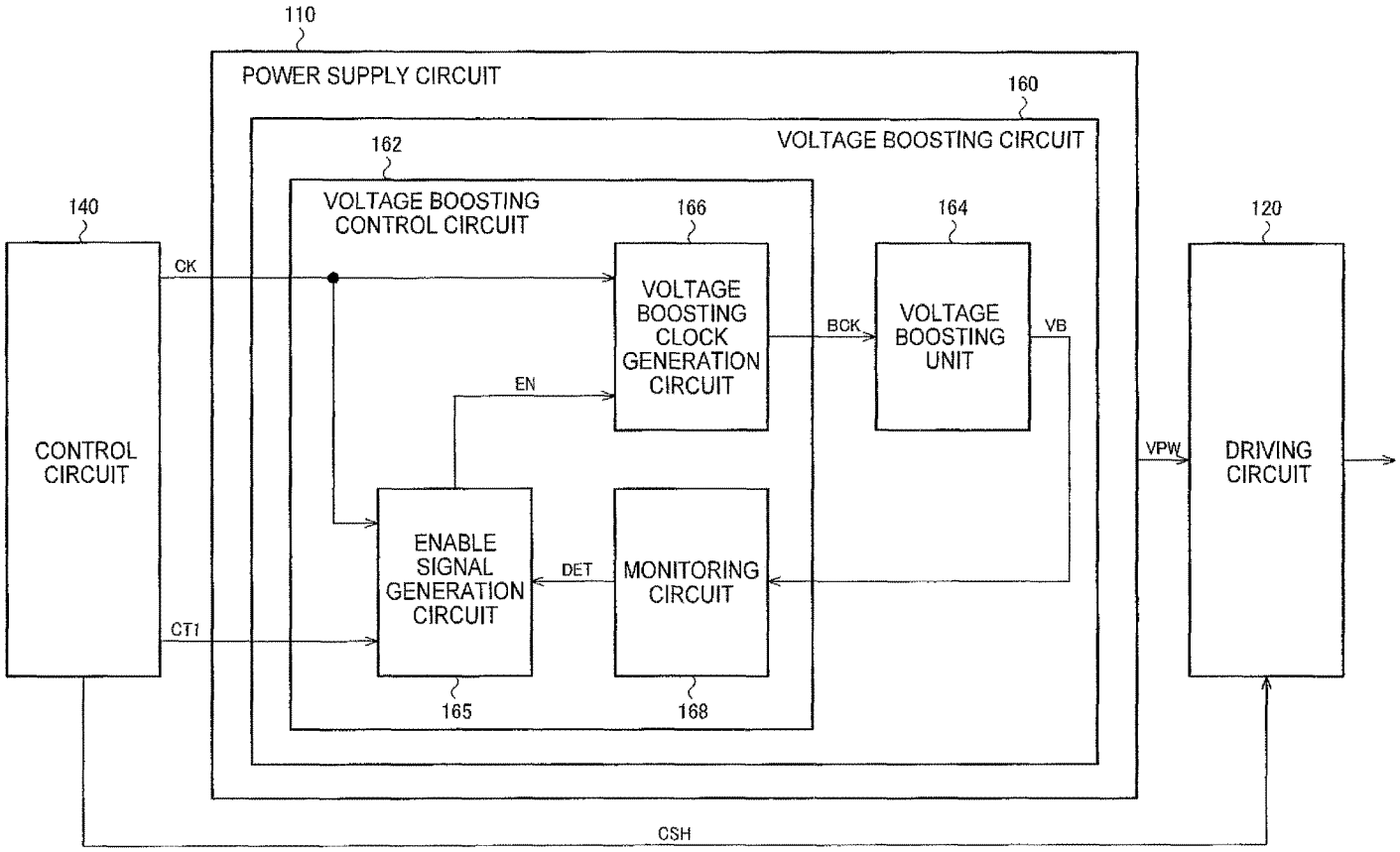
FIG. 3 shows a second exemplary configuration of the driver.

FIG. 3 shows a second exemplary configuration of the driver in this embodiment. This driver 100 includes a control circuit 140, the power supply circuit 110 having the voltage boosting circuit 160, and the driving circuit 120 that operates using a power supply voltage VPW from the power supply circuit 110 and samples and holds a driving voltage based on a sample-hold control signal CSH from the control circuit 140.

The voltage boosting circuit 160 includes a voltage boosting control circuit 162 that outputs a voltage boosting clock signal BCK based on a clock signal CK and a control signal CT1 from the control circuit 140, and a voltage boosting unit 164 that performs a charge pump operation using the voltage boosting clock signal BCK to generate a boosted voltage VB.

Note that in the following description, the same constituent elements as the constituent elements described in the first exemplary configuration will be assigned the same signs, and descriptions thereof will be omitted as appropriate.

Figure 4:
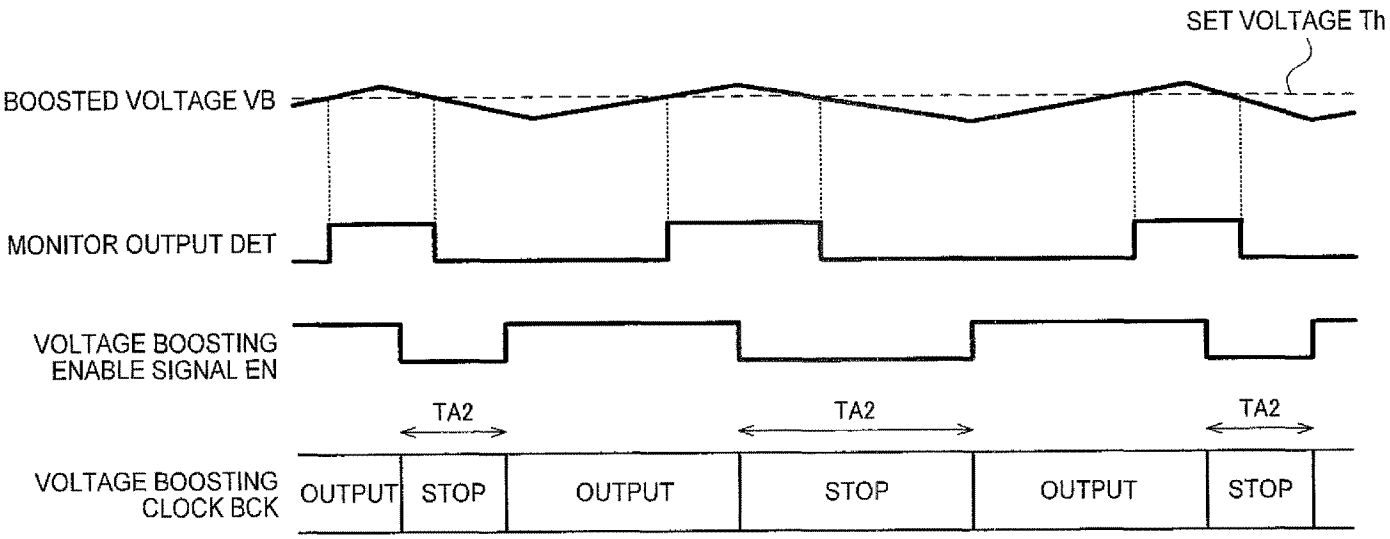
FIG. 4 is an illustrative diagram of operations in the second exemplary configuration of the driver.

FIG. 4 shows an illustrative diagram of operations in the second exemplary configuration of the driver 100. Here, an operation of performing feedback control on the boosted voltage VB will be described.

As shown in FIG. 4, the voltage boosting control circuit 162 monitors the boosted voltage VB, and stops the voltage boosting clock signal BCK in a second period TA2 after the boosted voltage VB exceeds a set voltage Th.

Specifically, the voltage boosting control circuit 162 includes a monitoring circuit 168 that monitors whether or not the boosted voltage VB has exceeded the set voltage Th and outputs a detection signal DET, an enable signal generation circuit 165 that generates a voltage boosting enable signal EN based on the detection signal DET, and a voltage boosting clock generation circuit 166 that generates the voltage boosting clock signal BCK based on the voltage boosting enable signal EN and the clock signal CK from the control circuit 140.

The detection signal DET is active (first logic level, or high level in FIG. 4) in the case where the boosted voltage VB is larger than the set voltage Th, and is inactive (second logic level, or low level in FIG. 4) in the case where the boosted voltage VB is smaller than the set voltage Th. The inactive state of the voltage boosting enable signal EN corresponds to the inactive state of the detection signal DET, and the inactive period of the voltage boosting enable signal EN is the second period TA2 in which the voltage boosting clock signal BCK stops. For example, the enable signal generation circuit 165 fetches (latches) the detection signal DET using the clock signal CK to generate the voltage boosting enable signal EN, and therefore, the second period TA2 starts after the time point when the boosted voltage VB exceeds the set voltage Th. Note that the second period TA2 may start at the time point when the boosted voltage VB exceeds the set voltage Th. For example, the inactive period of the detection signal DET may be the second period TA2.

As described above, the boosted voltage VB can be maintained at (in the vicinity of) the set voltage Th by stopping the voltage boosting clock signal BCK in the second period TA2 after the boosted voltage VB exceeds the set voltage Th. That is to say, by monitoring the boosted voltage VB and performing feedback control, it is possible to stop the voltage boosting operation to lower the boosted voltage VB if the boosted voltage VB exceeds the set voltage Th, and to resume the voltage boosting operation to raise the boosted voltage VB if the boosted voltage VB falls below the set voltage Th.

Figure 5:
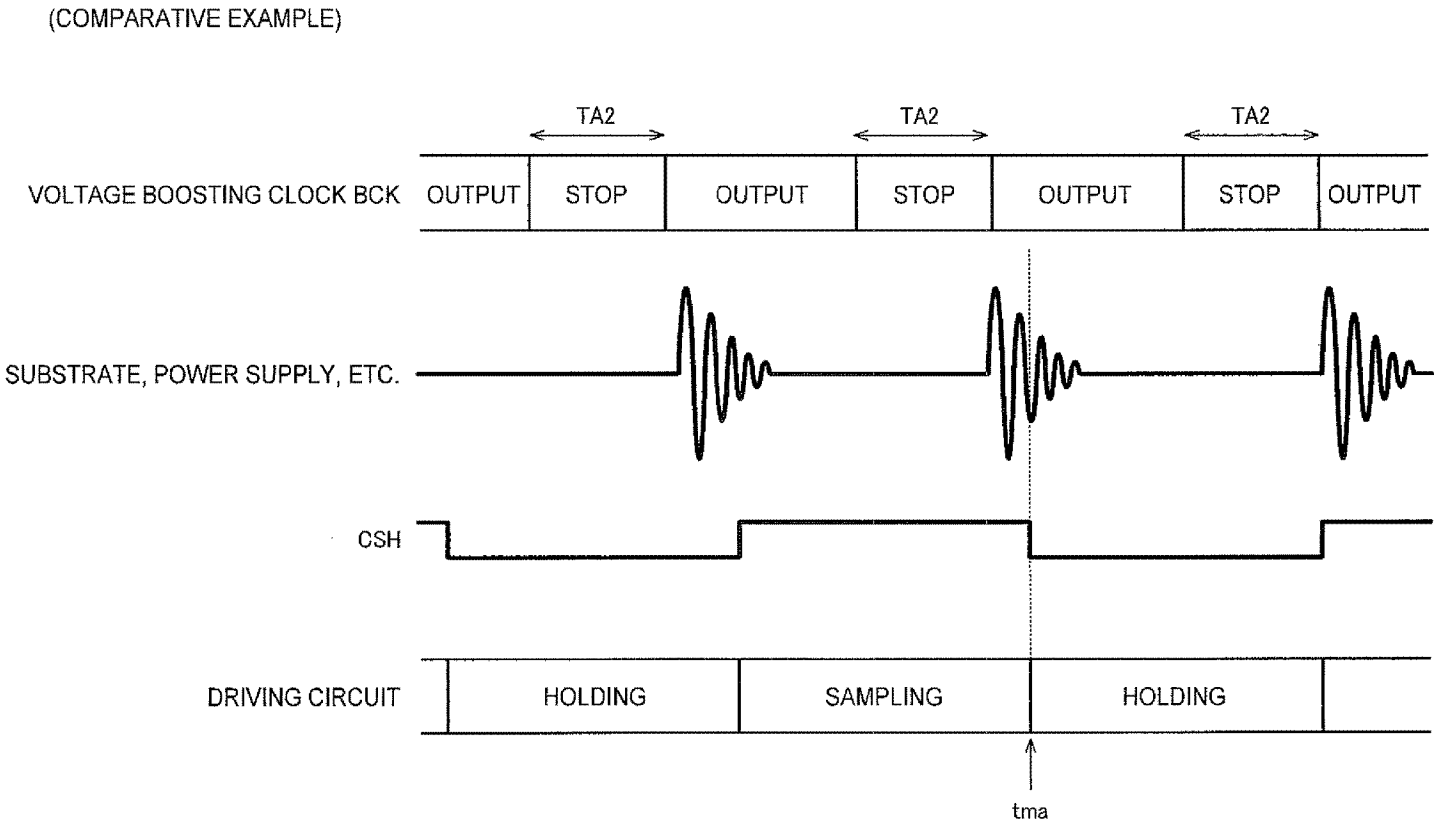
FIG. 5 shows a comparative example in the case of performing feedback control.

A comparative example in the case of performing such feedback control is shown in FIG. 5. FIG. 5 is an illustrative diagram of operations in the case of not stopping the voltage boosting operation in the first period TA1 that is when switching between the sampling and holding of the driving circuit 120.

The driving circuit 120 samples the driving voltage when the sample-hold control signal is at the high level (first logic level), and holds the sampled voltage when the sample-hold control signal is at the low level (second logic level). This operation is controlled by the control circuit 140, whereas the aforementioned feedback control is control performed internally in the voltage boosting circuit 160. For this reason, the stop and resumption of the voltage boosting clock signal BCK are executed at timings asynchronous with the sampling and holding of the driving circuit 120, and the voltage boosting clock signal BCK is resumed in the vicinity of the switching timing tma of the switching between the sampling and holding in some cases.

When resuming the voltage boosting operation using charge pumping, a larger charge transfer occurs than in the case of steadily performing charge pumping, in order to supplement the charge consumed by a load while the voltage boosting operation was stopped. For this reason, it is conceivable that large noise is generated in a substrate voltage of a semiconductor substrate, a ground voltage, or the like, for example, at the time of resuming the voltage boosting operation. In the case where this noise is generated in the vicinity of the switching timing tma of the switching between the sampling and holding, the error of the hold voltage becomes large, which lowers display quality.

As a method for reducing the noise generated in the charge pump circuit, it is conceivable to reduce the capacitance of the flying capacitor and increase the switching frequency, for example. However, although noise reduces in a steady charge pump operation (that does not repeat stop and resumption), noise (at the time of resumption) increases in a charge pump operation that repeats stop and resumption.

Figure 6:
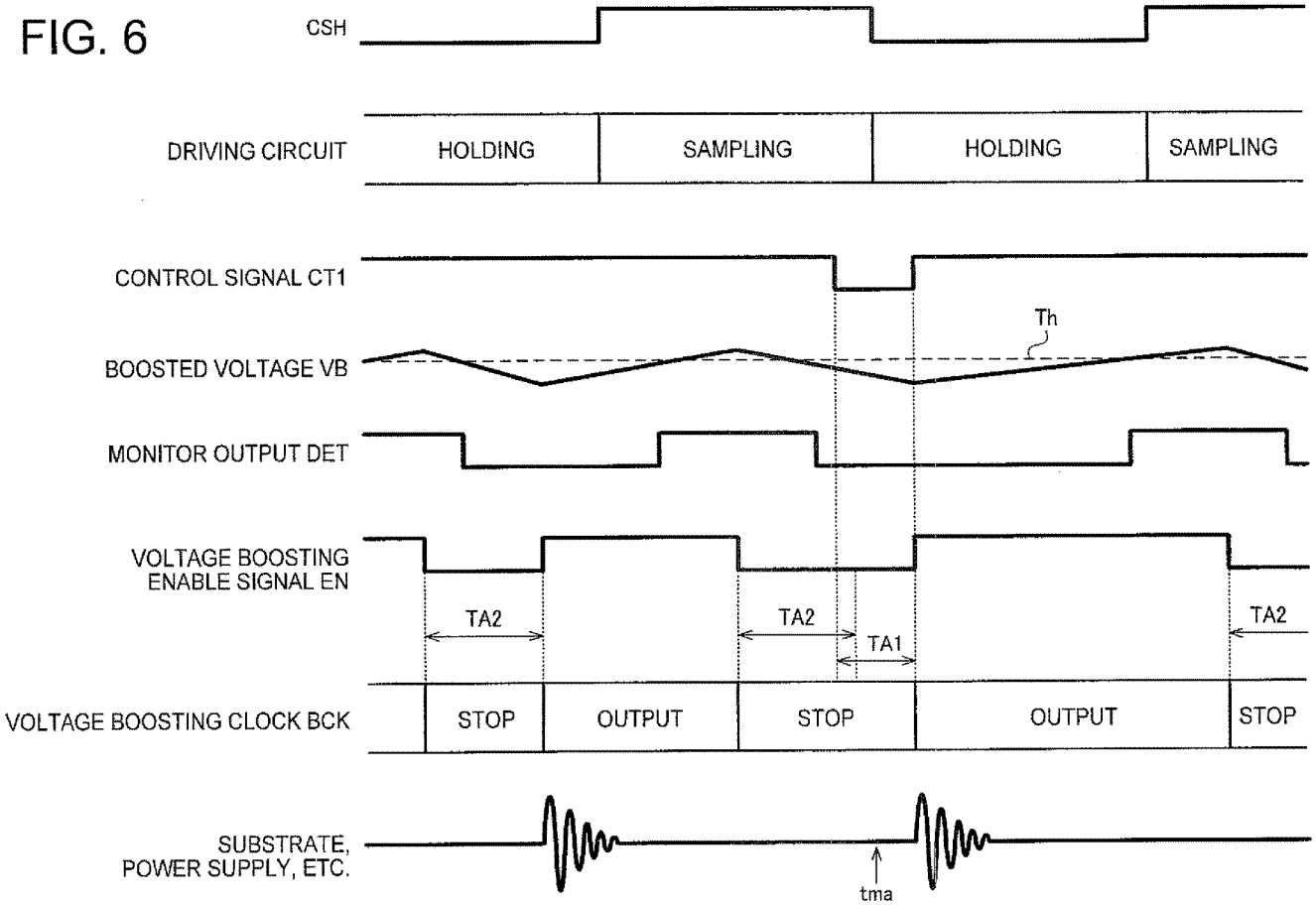
FIG. 6 is an illustrative diagram of operations in the second exemplary configuration of the driver.

This embodiment can solve the problem at the time of performing such feedback control. This point will now be described using FIG. 6. FIG. 6 is an illustrative diagram of operations in the case of stopping the voltage boosting operation in the first period TA1 that is when switching between the sampling and holding of the driving circuit 120.

As shown in FIG. 6, the voltage boosting enable signal EN that is input to the voltage boosting clock generation circuit 166 is inactive (low level) in the first period TA1 and the second period TA2. That is to say, the voltage boosting clock generation circuit 166 continues to stop the voltage boosting clock signal BCK even in the case where the second period TA2 ends in the middle of the first period TA1, and resumes the voltage boosting clock signal BCK after the first period TA1 ends.

Specifically, a control signal CT1 that is inactive (low level) in the first period TA1 is input to the enable signal generation circuit 165. The enable signal generation circuit 165 generates the voltage boosting enable signal EN that is inactive in the first period TA1 and the second period TA2 based on the control signal CT1 and a monitoring result (DET) from the monitoring circuit 168.

Thus, in this embodiment, since the voltage boosting clock signal BCK is stopped in the first period TA1, the voltage boosting operation is not resumed at the switching timing tma of the switching from the sampling period to the holding period of the driving circuit 120 even in the case of repeating stop and resumption of the voltage boosting clock signal BCK using the feedback control. It is thereby possible to prevent an error of the hold voltage caused by noise at the time of resumption.

3. Voltage Boosting Control Circuit

Figure 7:
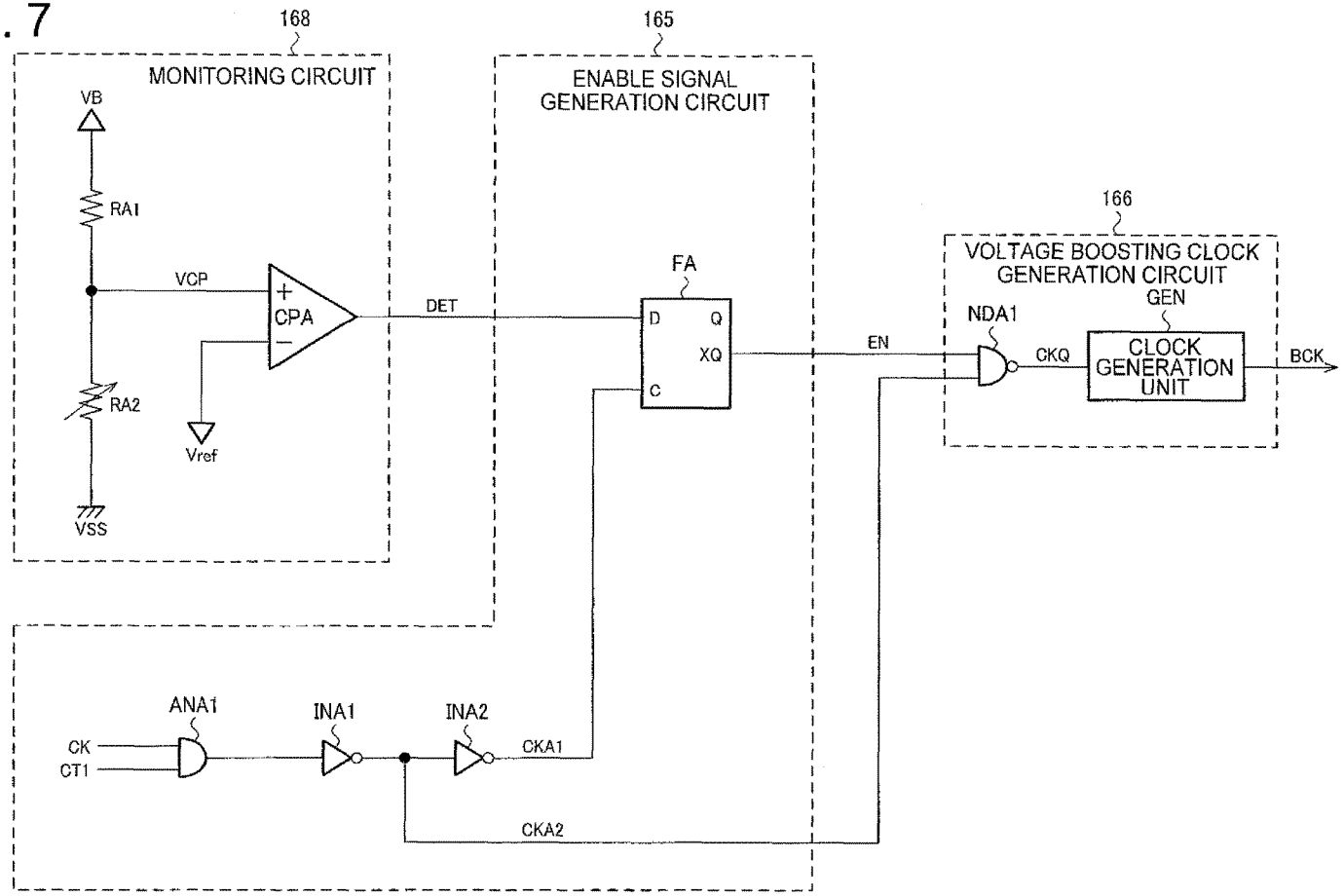
FIG. 7 shows a detailed exemplary configuration of a monitoring circuit, an enable signal generation circuit, and a voltage boosting clock generation circuit.

FIG. 7 shows a detailed exemplary configuration of the monitoring circuit 168, the enable signal generation circuit 165, and the voltage boosting clock generation circuit 166 in the voltage boosting control circuit 162.

The monitoring circuit 168 includes a comparator CPA, a resistance element RA1 provided between a node of the boosted voltage VB and a non-inverting input node (first input node) of the comparator CPA, and a resistance element RA2 provided between the non-inverting input node of the comparator CPA and a node of a ground voltage VSS (low-potential power supply voltage).

A reference voltage Vref is input to an inverting input node (second input node) of the comparator CPA from a reference voltage generation circuit (not shown) or the like, for example. The comparator CPA compares a voltage VCP obtained by means of resistance division of the resistance elements RA1 and RA2 with the reference voltage Vref, and outputs a comparison result as the detection signal DET. The resistance value of the resistance element RA2 is variable, and the resistance value of the resistance element RA2 is set by a register value written in a register unit (not shown), for example. The detection signal DET becomes active if the boosted voltage VB exceeds the set voltage Th, and this set voltage Th is set by the resistance value of the resistance element RA2.

The enable signal generation circuit 165 includes an AND circuit ANA1 that outputs a logical product of the clock signal CK and the control signal CT1 from the control circuit 140, an inverter INA1 that logically inverts the output of the AND circuit, an inverter INA2 that logically inverts the output of the inverter INA1, and a latch circuit FA (flip-flop circuit) that latches the detection signal DET using a clock signal CKA1 from the inverter INA2.

The voltage boosting clock generation circuit 166 includes a NAND circuit NDA1 that outputs a non-conjunction of the voltage boosting enable signal EN, which is logically inverted output of the latch circuit FA, and a clock signal CKA2 from the inverter INA1, and a clock generation unit GEN that generates the voltage boosting clock signal BCK based on a clock signal CKQ, which is the output of the NAND circuit NDA1.

The voltage boosting clock signal BCK is constituted by a plurality of clock signals for performing on-off control of the plurality of voltage boosting transistors (e.g., TR1 to TR6 in FIG. 12) included in the voltage boosting unit 164. The clock generation unit GEN generates the plurality of clock signals based on the clock signal CKQ from the NAND circuit NDA1.

Figure 8:
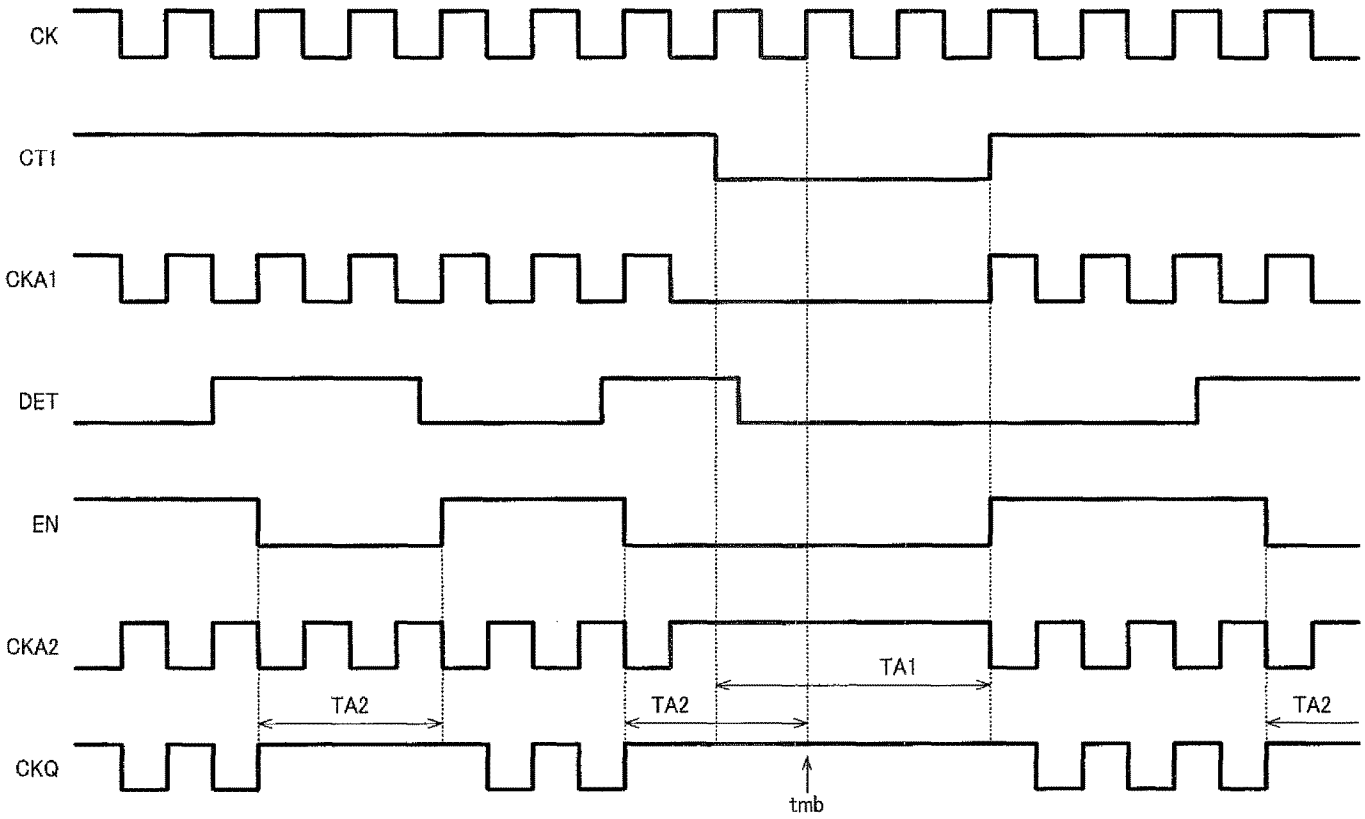
FIG. 8 is a timing chart of operations of the monitoring circuit, the enable signal generation circuit, and the voltage boosting clock generation circuit.

FIG. 8 shows a timing chart of operations in the exemplary configuration in FIG. 7. As shown in FIG. 8, the clock signal CK from the control circuit 140 is continuously input. Since the control signal CT1 is at the low level in the first period TA1 synchronously with the sample-hold operation of the driving circuit 120, the clock signal CKA1 is at the low level in the first period TA1.

The detection signal DET from the comparator CPA is latched when the clock signal CKA1 rises. Since the clock signal CKA1 is at the low level in the first period TA1, the voltage boosting enable signal EN does not change even if the detection signal DET changes. For example, in the case where the voltage boosting enable signal EN is at the low level when the first period TA1 starts, the voltage boosting enable signal EN is maintained at the low level until the first period TA1 ends. If the latch circuit FA latches the detection signal DET using the clock signal CK from the control circuit 140, the voltage boosting enable signal EN is switched to the high level at a timing tmb, and the second period TA2 ends. On the other hand, in this embodiment, even if the timing tmb is in the first period TA1, the voltage boosting enable signal EN is not switched to the high level until the first period TA1 ends.

The clock signal CKA2 does not change in the first period TA1, and the voltage boosting enable signal EN does not change in the second period TA2 (or in the first period TA1 and the second period TA2 in the case where the first TA1 starts during the second period TA2). For this reason, the clock signal CKQ that is input to the clock generation unit GEN does not change in the first period TA1 and the second period TA2.

Thus, the voltage boosting clock signal BCK is stopped in the first period TA1 and the second period TA2. Even in the case where the second period TA2 ends during the first period TA1, the voltage boosting clock signal BCK is not resumed until the first period TA1 ends.

4. Third Exemplary Configuration

Figure 9:
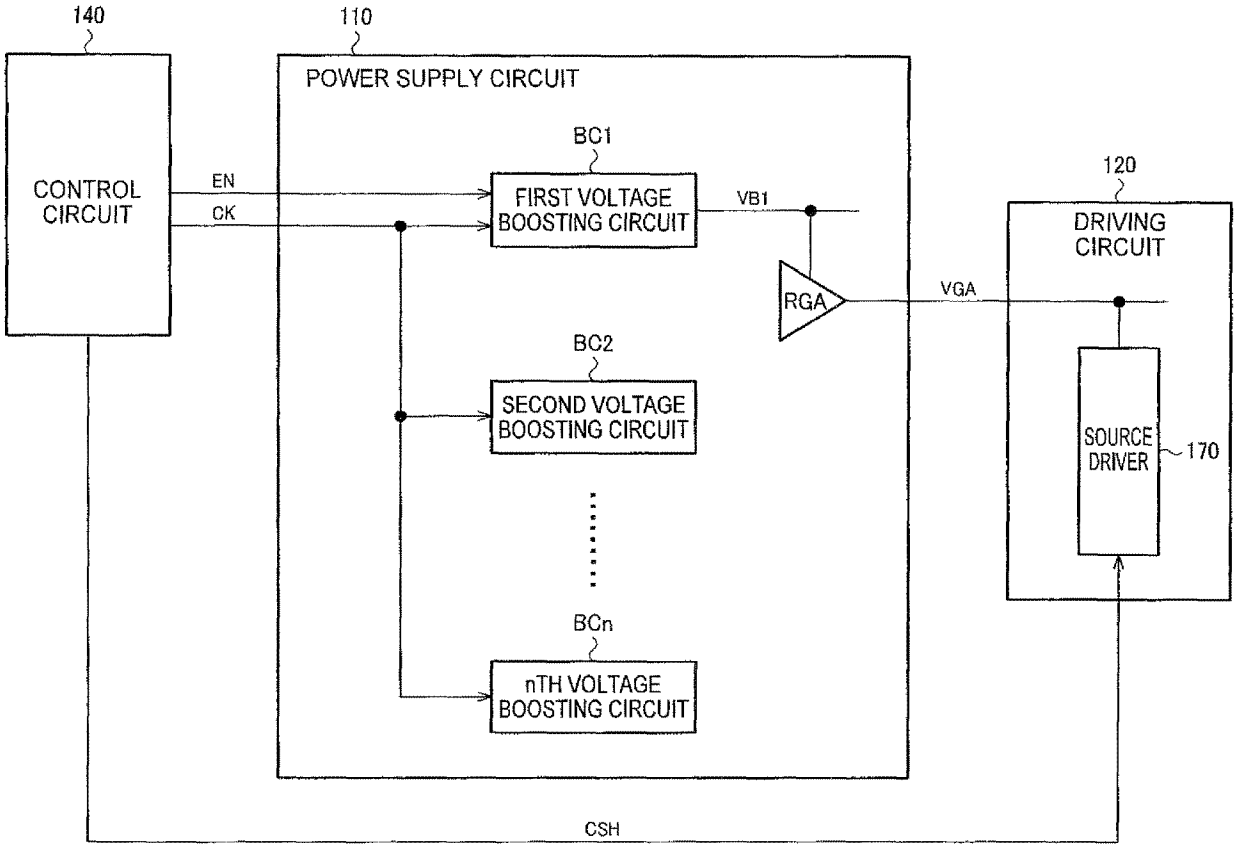
FIG. 9 shows a third exemplary configuration of the driver.

FIG. 9 shows a third exemplary configuration of the driver in this embodiment. This driver 100 includes the control circuit 140, the power supply circuit 110, and the driving circuit 120. Note that in the following description, the same constituent elements as the constituent elements described in the first and second exemplary configuration will be given the same reference numerals, and descriptions thereof will be omitted as appropriate.

In the case where the voltage boosting circuit 160 is deemed to be a first voltage boosting circuit BC1, the power supply circuit 110 further has second to nth voltage boosting circuits BC2 to BCn (n is an integer of 2 or larger). The current supply capability of the first voltage boosting circuit BC1 is higher than the current supply capabilities of the second to nth voltage boosting circuits BC2 to BCn. The voltage boosting control circuit 162 stops the voltage boosting clock signal BCK of the first voltage boosting circuit BC1 in the first period TA1.

The current supply capability of each voltage boosting circuit is a capability of the voltage boosting circuit to supply a current to a load, and is an output current with which the boosted voltage can be maintained at a prescribed voltage or larger, for example. In a charge pump circuit, the current supply capability changes in accordance with the size (on-resistance) of a transistor of a switched capacitor, the size of a capacitor, the switching frequency, or the like, for example. The current supply capability also changes depending on parasitic resistance or the like of an interconnect.

A high current supply capability means a large amount of charge to be moved in the charge pump operation, and the noise caused by this operation tends to be large. For this reason, the voltage boosting clock signal BCK of the voltage boosting circuit BC1 having the highest current supply capability is stopped in the first period TA1, and it is thereby possible to effectively reduce the influence exerted on the sample-hold operation of the driving circuit 120.

The driving circuit 120 has a source driver 170 that operates with a power supply voltage VGA that is based on a boosted voltage VB1 from the first voltage boosting circuit BC1. For example, the power supply circuit 110 further includes a regulator RGA (e.g., linear regulator) that lowers the boosted voltage VB1. The output of the regulator RGA is supplied as the power supply voltage VGA to the source driver 170.

The voltage boosting control circuit 162 of the first voltage boosting circuit BC1 stops the voltage boosting clock signal BCK in the first period TA1 that includes the switching timing tma of the switching from the sampling period to the holding period of the source driver 170.

The source driver 170 is a circuit that drives source lines of the display panel 200, which needs to rapidly drive the pixel capacitor connected to the source lines. Therefore, the source driver 170 is a circuit whose current consumption is large in the driver 100. For this reason, in the case where the power supply voltage VGA of the source driver 170 is generated based on the boosted voltage VB1, the first voltage boosting circuit BC1 has a high current supply capability. The voltage boosting clock signal BCK of the first voltage boosting circuit BC1 having such a high current supply capability is stopped in the first period TA1, and it is thereby possible to effectively reduce the influence exerted on the sample-hold operation of the driving circuit 120.

5. Source Driver

Figure 10:
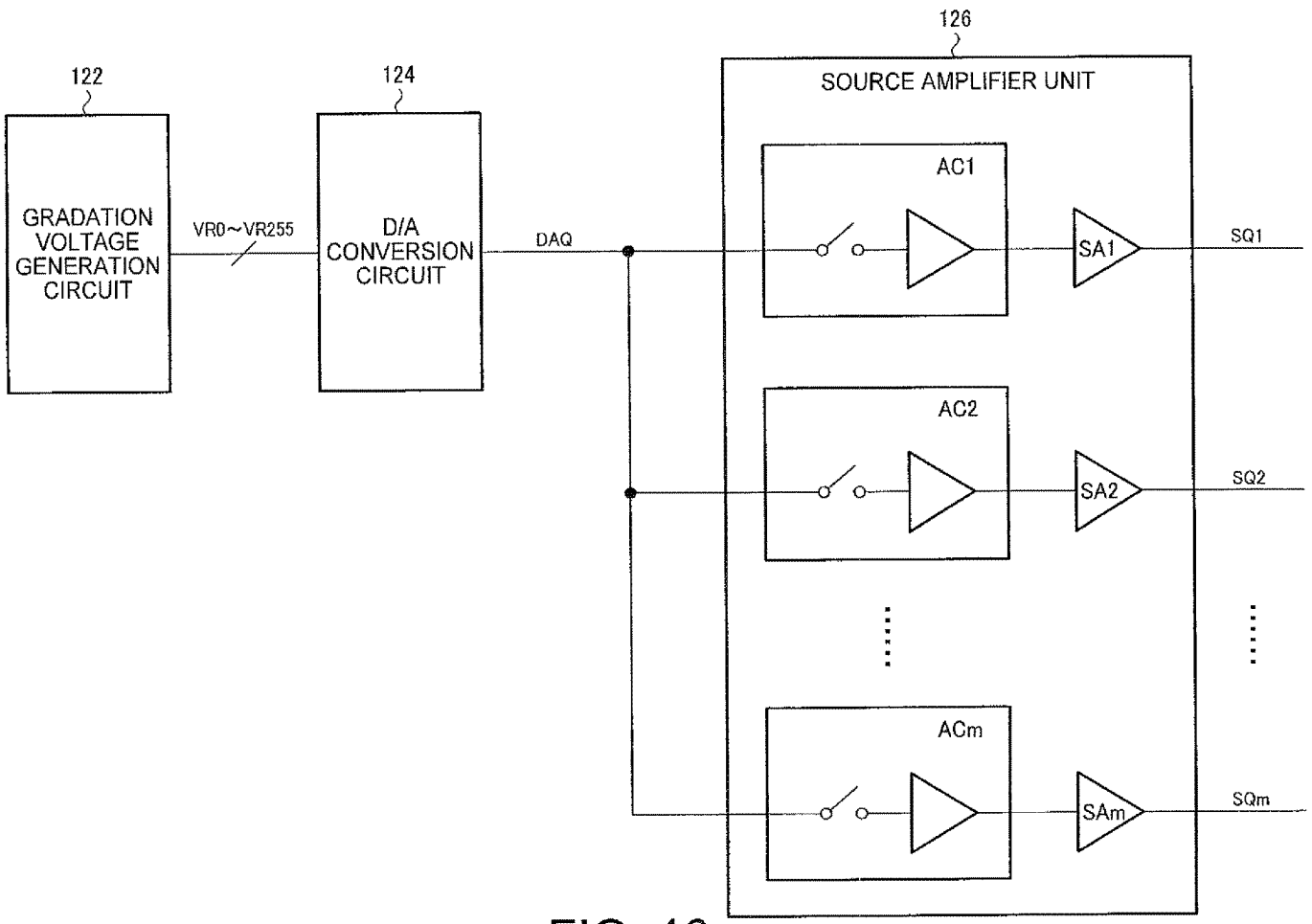
FIG. 10 shows a detailed exemplary configuration of a source driver.

FIG. 10 shows an exemplary detailed configuration of the source driver 170. The source driver 170 includes a gradation voltage generation circuit 122, a D/A conversion circuit 124, and a source amplifier unit 126.

The gradation voltage generation circuit 122 has a ladder resistor, and outputs gradation voltages (a plurality of reference voltages) generated by this ladder resistor, for example. For example, in the case of 256 gradations, the gradation voltages thereof will be referred to as V0 to V255.

The D/A conversion circuit 124 is a circuit that performs D/A conversion on display data (tone data), selects a voltage that corresponds to the display data from among the gradation voltages V0 to V255, and outputs the selected voltage as a source voltage (driving voltage, data voltage).

The source amplifier unit 126 includes sample-hold amplifier circuits AC1 to ACm, and source driving amplifier circuits SA1 to SAm. The switching elements shown with the amplifier circuits AC1 to ACm are sampling switching elements, and correspond to a switching element SW1 in FIG. 11A, for example. Note that a configuration may be employed in which the source driving amplifier circuits SA1 to SAm are omitted, and the sample-hold amplifier circuits AC1 to ACm directly drive the source lines.

Display data that correspond to the amplifier circuits AC1 to ACm are input to the D/A conversion circuit 124 in a time division manner. The D/A conversion circuit 124 performs D/A conversion on the time-division display data and outputs time-division source voltages. The amplifier circuits AC1 to ACm sequentially samples the time-division source voltages. The amplifier circuits SA1 to SAm amplify source voltages held by the amplifier circuits AC1 to ACm, and drive the source lines with the amplified voltages SQ1 to SQm.

For example, it is assumed that, in the case where m=3, the D/A conversion circuit 124 sequentially outputs gradation voltages VR10, VR50, and VR30. A sampling capacitor of the amplifier circuit AC1 is electrically connected when the gradation voltage VR10 is being output, and the amplifier circuit AC1 samples the gradation voltage VR10. Similarly, when the gradation voltages VR50 and VR30 are being output, sampling capacitors of the amplifier circuits AC2 and AC3 respectively turn on, and the amplifier circuits AC2 and AC3 sample the gradation voltages VR50 and VR30.

Figure 11B:
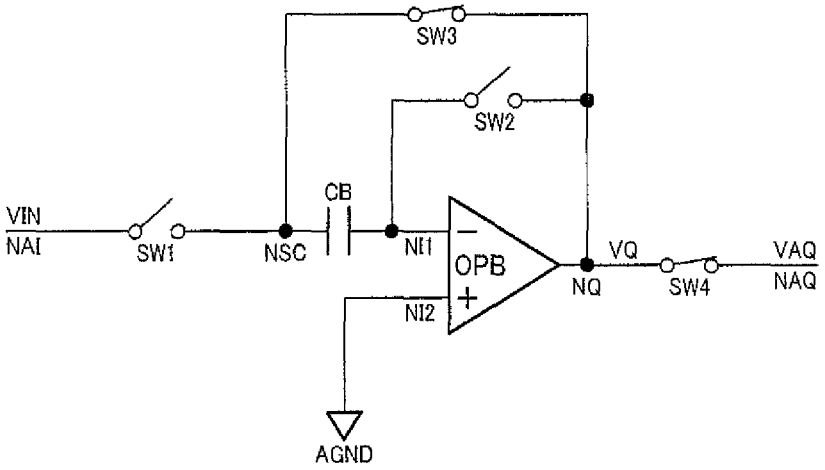

FIGS. 11A and 11B show detailed exemplary configurations of the sample-hold amplifier circuit.

The sample-hold amplifier circuit is constituted by a flip-around sample hold circuit.

That is to say, the amplifier circuit includes an operational amplifier OPB, and a sampling capacitor CB provided between an input node NAI of the amplifier circuit and a first input node NI1 (inverting input node) of the operational amplifier OPB. The amplifier circuit stores charge that corresponds to a voltage VIN at the input node NAI of the amplifier circuit in the sampling capacitor CB in the sampling period as shown in FIG. 11A, and outputs a voltage VAQ (=VIN) that corresponds to the charge stored in the sampling capacitor CB in the holding period as shown in FIG. 11B.

Specifically, the amplifier circuit includes a switching element SW1 provided between the input node NAI of the amplifier circuit and a node NSC, a switching element SW2 provided between the first input node NI1 of the operational amplifier OPB and an output node NQ of the operational amplifier OPB, a switching element SW3 provided between the node NSC and the output node NQ of the operational amplifier OPB, and a switching element SW4 provided between the output node NQ of the operational amplifier OPB and an output node NAQ of the amplifier circuit. A reference voltage AGND (analog ground) is input to a second input node NI2 (non-inverting input node) of the operational amplifier OPB.

In the sampling period, the switching elements SW1 and SW2 turn on, and charge that corresponds to VIN−VQ=VIN−AGND is stored in the sampling capacitor CB. In the holding period, the switching elements SW3 and SW4 turn on, and VAQ−VIN is output based on CB·(VIN−AGND)=CB·(VAQ−AGND) in conformity with charge conservation.

As described above, it is possible to provide a single D/A conversion circuit 124 for a plurality of source outputs and cause the source voltage to be sampled in a time division manner, using the amplifier circuit that samples and holds the source voltages. The circuit configuration can thereby be made more compact than in the case of providing a D/A conversion circuit for each source output. Even in the case of employing this kind of sample-hold amplifier circuit, according to this embodiment, it is possible to reduce the error of the source voltage generated by noise at the time of resuming the voltage boosting operation.

6. Voltage Boosting Circuit

Figure 12:
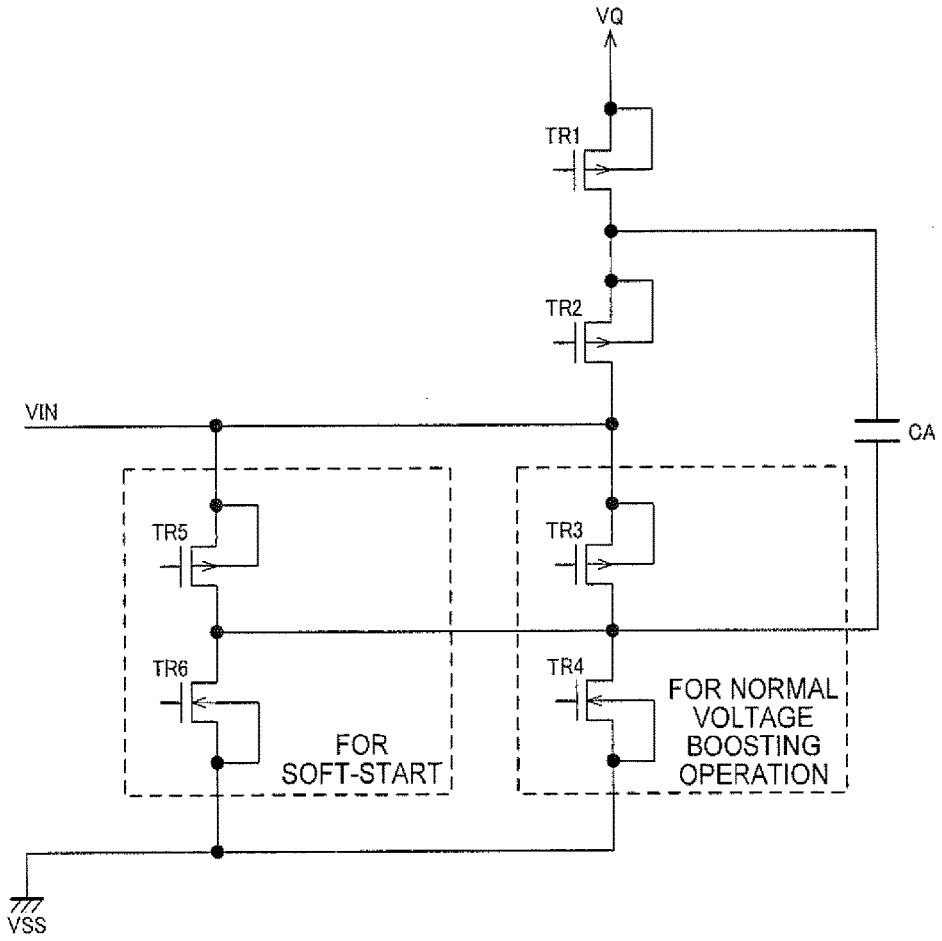
FIG. 12 shows a detailed exemplary configuration of a voltage boosting circuit.

FIG. 12 shows an exemplary configuration of the voltage boosting circuit that performs the voltage boosting operation using charge pumping. Although a charge pump circuit that boosts a voltage to a double voltage will be described here as an example, the invention is not limited thereto, and a charge pump circuit that boosts a voltage to a larger voltage may also be employed, for example.

The voltage boosting circuit includes P-type transistors TR1 to TR3 and TR5, N-type transistors TR4 and TR6, and a capacitor CA. The transistors TR5 and TR6 are for soft-start, and the size thereof is smaller than the size of the transistors TR3 and TR4 for a normal voltage boosting operation (that have a high on-resistance).

In the normal voltage boosting operation, in the first period (first phase), the transistors TR2, TR4, and TR6 turn on, the transistors TR1, TR3, and TR5 turn off, a first end of the capacitor CA is connected to the ground voltage VSS, and a second end of the capacitor CA is connected to the input voltage VIN. In a second period (second phase), the transistors TR2, TR4, and TR6 turn off, the transistors TR1, TR3, and TR5 turn on, the first end of the capacitor CA is connected to the input voltage VIN, and an output voltage VQ=2×VIN is output from the second end of the capacitor CA via the transistor TR1. In the case of soft-start, the transistors TR3 and TR4 turn off in the first period and the second period, and the operations of the transistors TR1, TR2, TR5, and TR6 are the same as in the normal voltage boosting operation.

The charge pump circuit performs a switching operation in the first period and the second period as mentioned above, and performs the voltage boosting operation by repeating charging and discharging of the capacitor CA. For this reason, noise is generated in the voltage VIN, VSS, VQ, or the like (particularly when resuming the voltage boosting operation). However, in this embodiment, the influence of the noise exerted on the sampling voltage can be eliminated by stopping the voltage boosting operation when switching between the sampling and holding of the driving circuit.

7. Power Supply Circuit

Figure 13:
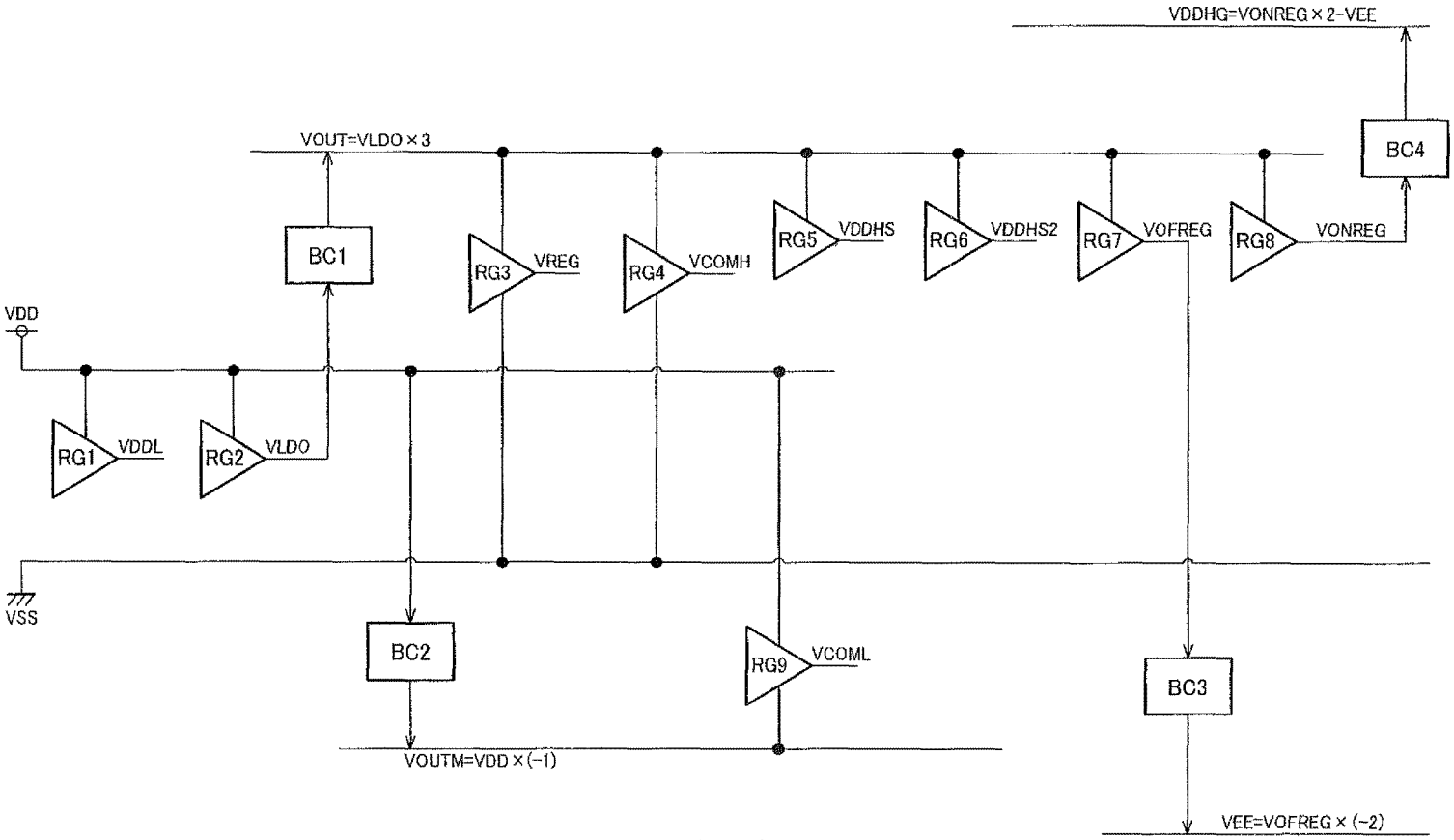
FIG. 13 shows a detailed exemplary configuration of a power supply circuit.
Figure 14:
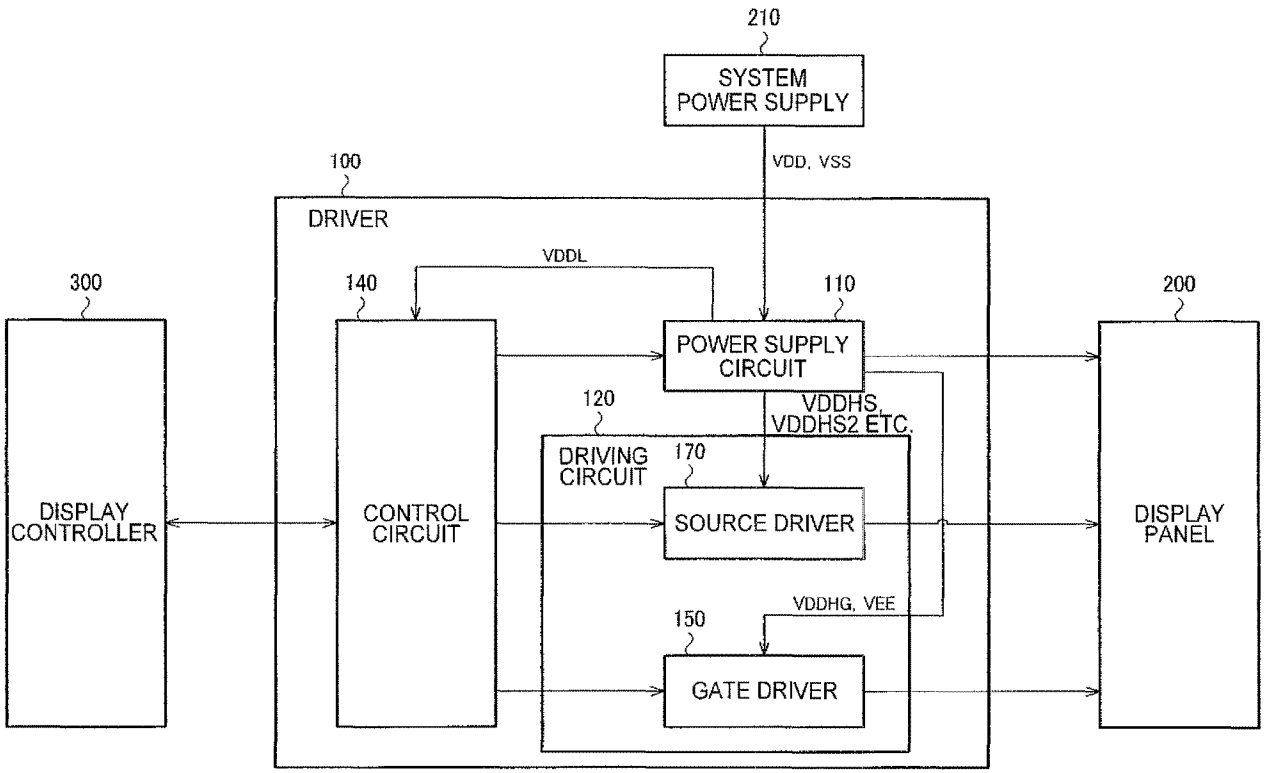
FIG. 14 shows an exemplary configuration of the driver to which the power supply circuit is applied.

FIG. 13 shows a detailed exemplary configuration of the power supply circuit 110 in FIG. 9. FIG. 14 shows an exemplary configuration of the driver 100 to which the power supply circuit 110 in FIG. 13 is applied.

The driver 100 in FIG. 14 includes the power supply circuit 110, the driving circuit 120, and the control circuit 140. The driving circuit 120 includes the source driver 170 and the gate driver 150. The gate driver 150 (scan driver) is a circuit that drives a gate line (scan line) of the display panel 200, and includes a level shifter, a buffer, or the like, for example. The control circuit 140 includes an interface circuit for communicating with the display controller 300, a line latch that latches image data transmitted from the display controller 300, a timing controller that controls display control timing, or the like. For example, the control circuit 140 is constituted by a gate array or the like.

The power supply circuit 110 in FIG. 13 includes first to fourth voltage boosting circuits BC1 to BC4 and first to ninth regulators RG1 to RG9. For example, the first to fourth voltage boosting circuits BC1 to BC4 are charge pump circuits, and the first to ninth regulators RG1 to RG9 are linear regulators.

The regulators RG1 and RG2 lower a power supply voltage VDD (high-potential power supply voltage) and generate voltages VDDL and VLDO. As shown in FIG. 14, the voltage VDDL is a power supply voltage of the control circuit 140 (logic circuit).

The voltage boosting circuit BC1 boosts a voltage VLDO1 to a triple voltage with the voltage VSS (low-potential power supply voltage) as a reference to generate a voltage VOUT. The regulators RG3, RG4, RG5, RG6, RG7, and RG8 lower the voltage VOUT and generate voltages VREG, VCOMH, VDDHS, VDDHS2, VOFREG, and VONREG. The regulator RG3 generates a voltage VREG with an output voltage of a bandgap circuit (not shown) as a reference. The other regulators RG1, RG2, and RG4 to RG9 output respective voltages with the voltage VREG as a reference. As shown in FIG. 14, the voltages VDDHS and VDDHS2 are power supply voltages of the source driver 170. The voltage VCOMH is a positive voltage of the common voltages at the time of driving the source lines of the display panel 200.

The voltage boosting circuit BC2 inverts the voltage VDD with the voltage VSS as a reference to generate a negative voltage VOUTM. The regulator RG9 generates a voltage VCOML from the voltage VDD and the voltage VOUTM. The voltage VCOML is a negative voltage of the common voltage at the time of driving the source lines of the display panel 200.

The voltage boosting circuit BC3 boosts the voltage VOFREG to a double voltage with an inverted polarity with the voltage VSS as a reference, and generates a negative voltage VEE. As shown in FIG. 14, the voltage VEE is a negative power supply voltage of the gate driver 150.

The voltage boosting circuit BC4 generates a voltage VDDHG=VONREG×2−VEE from the voltage VONREG and the voltage VEE. As shown in FIG. 14, the voltage VDDHG is a positive power supply voltage of the gate driver 150.

8. Electro-Optical Apparatus and Electronic Device

Figure 15:
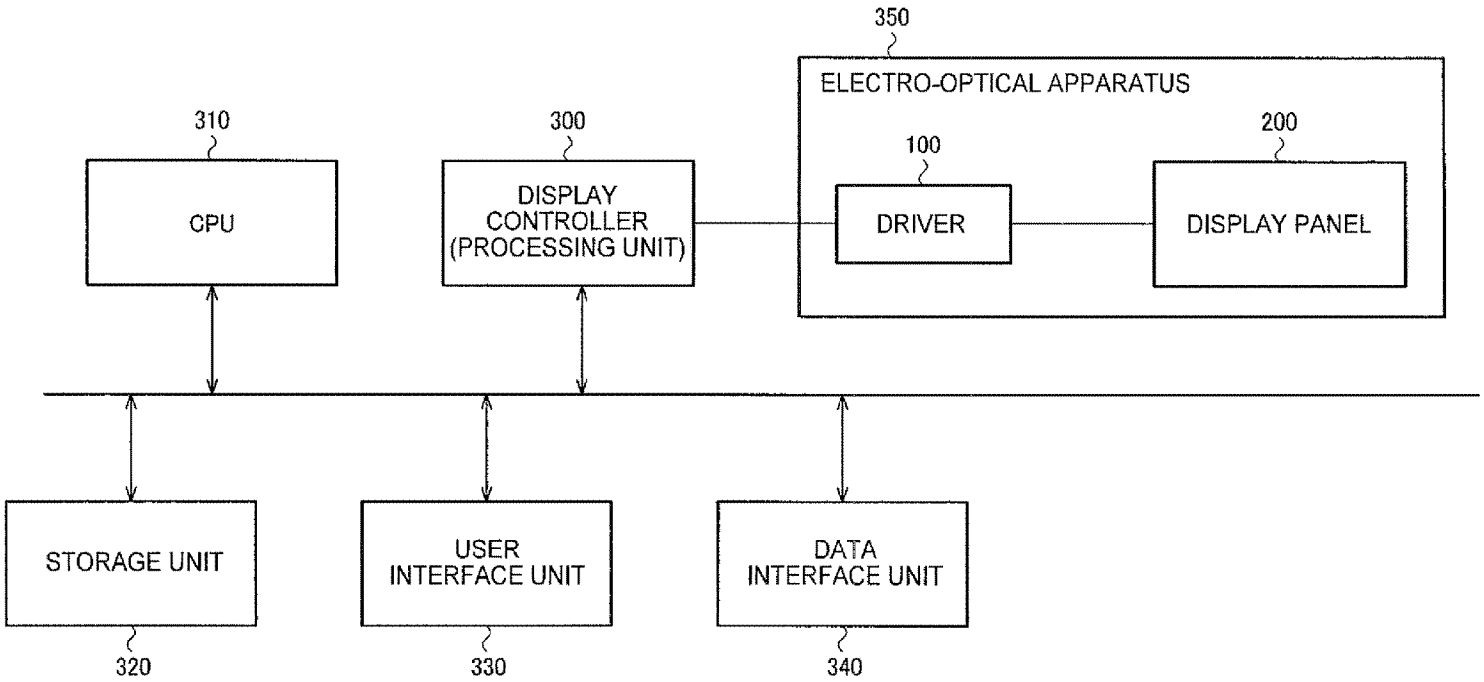
FIG. 15 shows an exemplary configuration of an electro-optical apparatus and an electronic device.

FIG. 15 shows an exemplary configuration of an electro-optical apparatus and an electronic device to which the driver 100 according to this embodiment can be applied. Various electronic devices equipped with a display device, such as a projector, a television apparatus, an information processing apparatus (computer), a mobile information terminal, a car navigation system, and a mobile game terminal, can be assumed to be the electronic device according to this embodiment.

The electronic device shown in FIG. 15 includes an electro-optical apparatus 350, a display controller 300 (host controller; first processing unit), a CPU 310 (second processing unit), a storage unit 320, a user interface unit 330, and a data interface unit 340. The electro-optical apparatus 350 includes the driver 100 and the display panel 200.

The display panel 200 is a liquid crystal display panel of a matrix type, for example. Alternatively, the display panel 200 may be an EL (Electro-Luminescence) display panel using self-light emitting elements. For example, a flexible substrate is connected to the display panel 200, the driver 100 is installed in this flexible substrate, and the electro-optical apparatus 350 is thus configured. Note that the driver 100 and the display panel 200 may be incorporated as individual parts in the electronic device, rather than being configured as the electro-optical apparatus 350. For example, a configuration may be employed in which a flexible substrate for leading out wiring is connected to the display panel 200, the driver 100 is installed together with the display controller 300 or the like in a rigid substrate, and the flexible substrate is connected to this rigid substrate, thereby installing the display panel 200.

The user interface unit 330 is an interface unit that accepts various user operations. For example, the user interface unit 330 is constituted by buttons, a mouse, a keyboard, a touch panel installed in the display panel 200, or the like. The data interface unit 340 is an interface unit that inputs and outputs image data and control data. For example, the data interface unit 340 is a wired communication interface such as a USB, or a wireless communication interface such as a wireless LAN. The storage unit 320 stores the image data that is input from the data interface unit 340. Alternatively, the storage unit 320 functions as a working memory of the CPU 310, the display controller 300, or the like. The CPU 310 performs control processing for each part of the electronic device, various kinds of data processing, or the like. The display controller 300 performs control processing for the driver 100. For example, the display controller 300 converts image data transferred from the data interface unit 340, the storage unit 320, or the like into data in a format that can be accepted by the driver 100, and outputs the converted image data to the driver 100. The driver 100 drives the display panel 200 based on the image data transferred from the display controller 300.

Note that although this embodiment has been described above in detail, those skilled in the art will easily understand that various modifications are possible without substantially departing from the new matter and the effect of the invention. Accordingly, all those modifications are to be encompassed in the scope of the invention. For example, a term that is used at least once together with another term having a broader or the same meaning in the specification or the drawings may be replaced with the other term in any part of the specification or the drawings. All combinations of this embodiment and the modifications are also encompassed in the scope of the invention. Configurations, operations, or the like of the power supply circuit, the voltage boosting circuit, the driving circuit, the driver, the electro-optical apparatus, and the electronic device are not limited to those described in this embodiment either, and may be modified in various manners.

This application claims priority from Japanese Patent Application No. 2015-042037 filed in the Japanese Patent Office on Mar. 4, 2015 the entire disclosure of which is hereby incorporated by reference in its entirely.

What is claimed is:

1. A driver comprising:

a power supply circuit including a voltage boosting circuit that generates a boosted voltage by performing a voltage boosting operation; and a driving circuit that receives a power supply from the power supply circuit, and samples and holds a driving voltage to drive a display panel, wherein the voltage boosting circuit has:

a voltage boosting unit having a voltage boosting transistor; and a voltage boosting control circuit that outputs a voltage boosting clock for controlling the voltage boosting transistor to the voltage boosting unit, and the voltage boosting control circuit stops the voltage boosting clock in a first period that includes a switching timing of switching from a sampling period to a holding period of the driving circuit.

2. The driver according to claim 1, wherein the voltage boosting control circuit monitors the boosted voltage, and stops the voltage boosting clock in a second period after the boosted voltage exceeds a set voltage.

3. The driver according to claim 2, wherein the voltage boosting control circuit has:

a monitoring circuit that monitors the boosted voltage; and a voltage boosting clock generation circuit that generates the voltage boosting clock, and a voltage boosting enable signal that is input to the voltage boosting clock generation circuit is inactive in the first period and the second period.

4. The driver according to claim 3, wherein the voltage boosting control circuit has an enable signal generation circuit to which a control signal that is inactive in the first period is input, the enable signal generation circuit generating the voltage boosting enable signal that is inactive in the first period and the second period based on the control signal and a monitoring result from the monitoring circuit.

5. The driver according to claim 1, wherein the voltage boosting circuit generates the boosted voltage by performing the voltage boosting operation using charge pumping.

6. The driver according to claim 1, wherein, in a case of deeming the voltage boosting circuit to be a first voltage boosting circuit, the power supply circuit further has second to nth voltage boosting circuits (n is an integer of 2 or larger), a current supply capability of the first voltage boosting circuit is higher than current supply capabilities of the second to nth voltage boosting circuits, and the voltage boosting control circuit stops the voltage boosting clock of the first voltage boosting circuit in the first period.

7. The driver according to claim 6, wherein the driving circuit has a source driver that operates with a power supply voltage that is based on a boosted voltage from the first voltage boosting circuit.

8. The driver according to claim 7, wherein the voltage boosting control circuit stops the voltage boosting clock in the first period that includes a switching timing of switching from a sampling period to a holding period of the source driver.

9. The driver according to claim 1, wherein the driving circuit has a source driver that includes an amplifier circuit constituted by a flip-around sample-hold circuit.

10. The driver according to claim 9, wherein the amplifier circuit has:

an operational amplifier; and a sampling capacitor provided between an input node of the amplifier circuit and a first input node of the operational amplifier, and the amplifier circuit stores charge that corresponds to a voltage of the input node of the amplifier circuit in the sampling capacitor in the sampling period, and outputs a voltage that corresponds to the charge stored in the sampling capacitor in the holding period.

11. An electro-optical apparatus comprising the driver according to claim 1.

12. An electronic device comprising the driver according to claim 1.

13. A driver comprising:

a power supply circuit including a boosting circuit that generates a boosted voltage by performing a boosting operation; and a driving circuit that receives a power supply voltage from the power supply circuit, and samples a driving voltage to drive a display panel, wherein the boosting circuit having:

a boosting unit having a boosting transistor; and a boosting control circuit that outputs a boosting clock for controlling the boosting transistor to the boosting unit, and the boosting control circuit stops the boosting clock in a first period that includes a timing of an end of a sampling period of the driving circuit.

* * * * *